US010729614B2

(12) United States Patent
Marton et al.

(10) Patent No.: US 10,729,614 B2
(45) **Date of Patent: *Aug. 4, 2020**

(54) THERAPEUTIC VIBRATING ROLLER

(71) Applicant: Hyper Ice, Inc., Irvine, CA (US)

(72) Inventors: Robert Marton, Yorba Linda, CA (US); Anthony Katz, Laguna Niguel, CA (US)

(73) Assignee: Hyper Ice, Inc., Irvine, CA (US)

( * ) Notice: Subject to any disclaimer, the term of this patent is extended or adjusted under 35 U.S.C. 154(b) by 297 days.

This patent is subject to a terminal disclaimer.

(21) Appl. No.: 15/949,593

(22) Filed: Apr. 10, 2018

(65) Prior Publication Data

US 2018/0228691 A1 Aug. 16, 2018

Related U.S. Application Data

(63) Continuation of application No. 14/628,233, filed on Feb. 21, 2015, now Pat. No. 9,968,513.
(Continued)

(51) Int. Cl.
*A61H 23/02* (2006.01)
*A61H 15/00* (2006.01)

(52) U.S. Cl.
CPC ..... *A61H 23/02* (2013.01); *A61H 15/00* (2013.01); *A61H 23/0263* (2013.01); *A61H 2015/0014* (2013.01); *A61H 2015/0071* (2013.01); *A61H 2201/0153* (2013.01); *A61H 2201/0214* (2013.01); *A61H 2201/0242* (2013.01); *A61H 2201/1695* (2013.01)

(58) Field of Classification Search
CPC ..... A61H 15/0071; A61H 15/0078; A61H 15/0085; A61H 23/0254; A61H 23/0263; A61H 2023/0272; A61H 2023/0281
See application file for complete search history.

(56) References Cited

U.S. PATENT DOCUMENTS 2,675,800 A 4/1954 Voorhees
2,943,621 A 7/1960 Phillips
(Continued)

FOREIGN PATENT DOCUMENTS

CN 204334213 U 5/2015
DE 9200901.8 U1 7/1992
(Continued)

*Primary Examiner* — LaToya M Louis
(74) *Attorney, Agent, or Firm* — Patterson Intellectual Property Law, P.C.; Jerry Turner Sewell

(57) ABSTRACT

A portable vibrating roller includes an outer roller structure having a plurality of grooves and ribs. A hollow cylindrical bore extends longitudinally through the shell. A vibration system having a first end cap and a second end cap fits within the bore. A battery positioned within the shell near one end cap provides electrical power to a motor positioned within the shell near the other end cap to cause the motor to rotate an output shaft at a plurality of angular velocities to rotate an eccentric mass located approximately midway between the two end caps. The rotating eccentric mass causes vibration. A motor control circuit receives input power from a battery and selectively provides output power to the motor in response to the operation of a switch on the first end cap. The output power is varied to control the angular velocity of the output shaft of the motor and to thereby control a frequency of vibration caused by the eccentric mass.

5 Claims, 6 Drawing Sheets

Related U.S. Application Data

(60) Provisional application No. 61/942,929, filed on Feb. 21, 2014.

(56) References Cited

U.S. PATENT DOCUMENTS

| | | | |
|---|---|---|---|
| 4,878,489 | A | 11/1989 | Kamayachi |
| 5,123,406 | A | 6/1992 | Masuda |
| 5,554,102 | A | 9/1996 | Chiou |
| 6,694,550 | B2 | 2/2004 | Lee |
| 8,002,682 | B2 | 8/2011 | Dye |
| 8,337,437 | B2 | 12/2012 | Hitzmann |
| 8,500,663 | B2 | 8/2013 | Godfrey et al. |
| 8,556,837 | B1 | 10/2013 | Poirer |
| 9,132,055 | B1 | 9/2015 | Wallace |
| 2003/0131416 | A1 | 7/2003 | Lee |
| 2005/0070827 | A1 | 3/2005 | Lee |
| 2009/0176635 | A1 | 7/2009 | Brinson |
| 2012/0172771 | A1 | 7/2012 | Jian |
| 2012/0310125 | A1 | 12/2012 | Hall |
| 2013/0267396 | A1 | 10/2013 | Dye |
| 2013/0281892 | A1 | 10/2013 | Godfrey et al. |

FOREIGN PATENT DOCUMENTS

| | | | |
|---|---|---|---|
| DE | 102006058876 | A1 | 10/2007 |
| DE | 202014004900 | U1 | 10/2014 |
| DE | 202014004901 | U1 | 10/2014 |
| DE | 102014211779 | A1 | 12/2015 |
| DE | 102014211780 | A1 | 12/2015 |
| DE | 102015002235 | A1 | 12/2015 |

THERAPEUTIC VIBRATING ROLLER

RELATED APPLICATIONS

The present application is a continuation of U.S. patent application Ser. No. 14/628,233, filed on Feb. 21, 2015, which claims the benefit of priority under 35 USC § 119(e) to U.S. Provisional Application No. 61/942,929, filed on Feb. 21, 2014, both of which are incorporated by reference herein.

BACKGROUND OF THE INVENTION

Field of the Invention

The present invention is in the field of therapeutic devices, and, more particularly, is in the field of rollers for kneading muscles and other tissue.

Description of the Related Art

Foam rollers are used to provide tissue mobilization, which provides benefits such as improvement of muscle flexibility and tightness, reduction of lactic acid in the muscles, reduction of muscle fibrosis (adhesions and scar tissue), and reduction of risk of injury. Increased muscle tone and tightness can be achieved by applying pressure to the muscles via the roller.

Vibrating foam rollers provide the additional benefit of increasing blood flow, increasing oxygen and nutrient consumption by muscles and improving regeneration of damaged tissues.

SUMMARY OF THE INVENTION

A need exists for an apparatus and a method for improvements to therapeutic rollers. The system disclosed and claimed herein is responsive to the need.

A system disclosed herein comprises a generally cylindrical foam roller having a hollow core. A vibration system is positioned within the hollow core. The vibration system is selectably activated to operate at one of a plurality of vibrating frequencies so that the foam roller vibrates as it is applied to a portion of a body.

An aspect of the system disclosed herein is a portable vibrating roller. The vibrating roller includes an outer roller structure having a plurality of grooves and ribs. A hollow cylindrical bore extends longitudinally through the shell. A vibration system having a first end cap and a second end cap fits within the bore. A battery positioned within the shell near one end cap provides electrical power to a motor positioned within the shell near the other end cap to cause the motor to rotate an output shaft at a plurality of angular velocities to rotate an eccentric mass located approximately midway between the two end caps. The rotating eccentric mass causes vibration. A motor control circuit receives input power from a battery and selectively provides output power to the motor in response to the operation of a switch on the first end cap. The output power is varied to control the angular velocity of the output shaft of the motor and to thereby control a frequency of vibration caused by the eccentric mass.

An aspect in accordance with embodiments disclosed herein is a portable vibrating roller for therapeutic exercise. The roller comprises an outer roller structure comprising a firm, pliable foam material formed as a cylinder having a generally cylindrical outer circumference. The outer roller structure includes a plurality of grooves and ribs positioned around the outer circumference. The outer roller structure includes a hollow cylindrical bore extending longitudinally through the foam material. A vibration system comprising a shell is sized to fit within the hollow cylindrical bore of the outer roller structure. The shell has a first end cap and a second end cap. The shell encloses and supports a motor positioned proximate to one of the first end cap and the second end cap. The motor is responsive to applied power to rotate an output shaft at a selected one of a plurality of angular velocities. A battery is positioned proximate to the other of the first end cap and the second end cap. An eccentric mass is coupled to the output shaft of the motor to rotate and cause vibration when the output shaft is rotated by the motor. The eccentric mass is positioned at a location approximately midway between the first end cap and the second end cap. A motor control circuit is electrically coupled to receive input power from the battery and to selectively provide output power to the motor. The motor control circuit is responsive to the operation of a switch on one of the first end cap and the second end cap to vary the output power provided to the motor to control the angular velocity of the output shaft of the motor and to thereby control a frequency of vibrations caused by the eccentric mass. Preferably, the positioning of the eccentric mass causes the vibrations generated by the eccentric mass to have greater amplitudes nearer to the center of the vibration system than to the first end cap and the second end cap. Preferably, the positions of the motor and the battery proximate the respective end caps cause the vibration system to have a center of gravity nearer the middle of the vibration system than to either of the first end cap or the second end cap. Preferably, the angular velocity of the output shaft of the motor and the resulting frequency of vibration caused by the eccentric mass are selected to provide a desired vibrational effect to the tissues of a body when the outer circumference of the outer roller structure is applied to the body.

Another aspect in accordance with embodiments disclosed herein is a vibration system for therapeutic massage. The vibration system comprises a shell having a first end cap and a second end cap. A motor is positioned within the shell proximate to one of the first end cap and the second end cap. The motor is responsive to applied power to rotate an output shaft at a selected one of a plurality of angular velocities. A battery is positioned proximate to the other of the first end cap and the second end cap. An eccentric mass is coupled to the output shaft of the motor to rotate and cause vibration when the output shaft is rotated by the motor. The eccentric mass is positioned at a location approximately midway between the first end cap and the second end cap. A motor control circuit is electrically coupled to receive input power from the battery and to selectively provide output power to the motor. The motor control circuit is responsive to the operation of a switch on one of the first end cap and the second end cap to vary the output power provided to the motor to control the angular velocity of the output shaft of the motor and to thereby control a frequency of vibrations caused by the eccentric mass.

BRIEF DESCRIPTION OF THE DRAWINGS

Embodiments in accordance with aspects of the present invention are described below in connection with the attached drawings in which.

DETAILED DESCRIPTION OF PREFERRED EMBODIMENTS

The improvements to the therapeutic roller are disclosed herein with respect to exemplary embodiments of a system and a method. The embodiments are disclosed for illustration of the system and the method and are not limiting except as defined in the appended claims. Although the following description is directed to a particular embodiment of a vibrating therapeutic roller, it should be understood that the disclosed system and method can be applied to other embodiments of therapeutic vibrating rollers.

Figure 1:
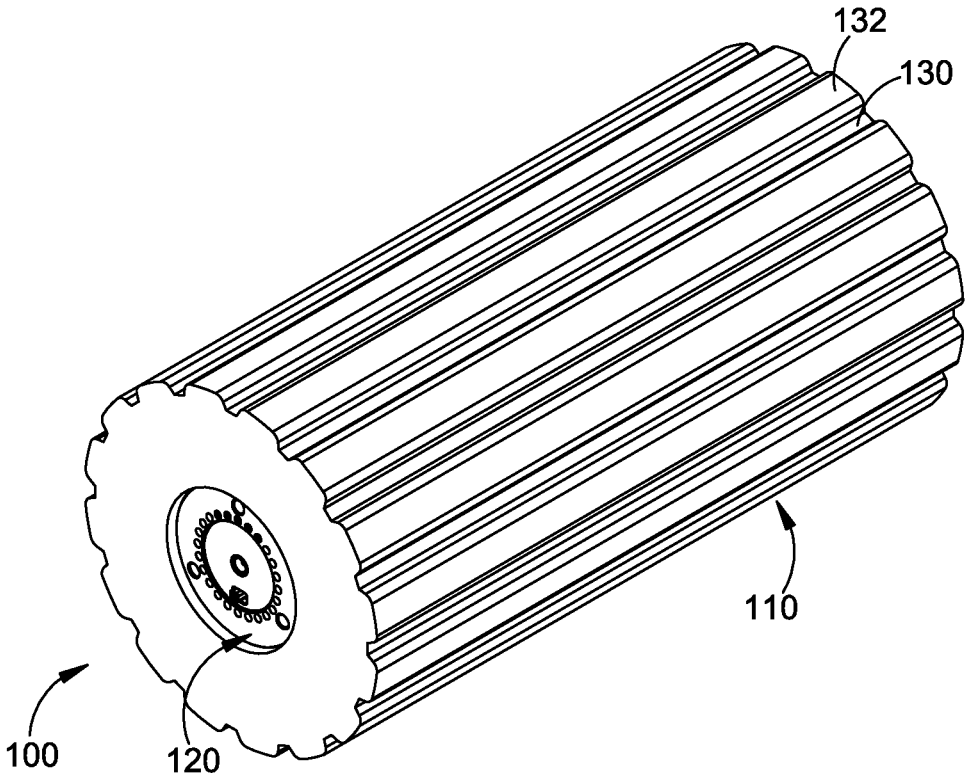
FIG. 1 illustrates a front perspective view of the vibrating roller.
Figure 2:
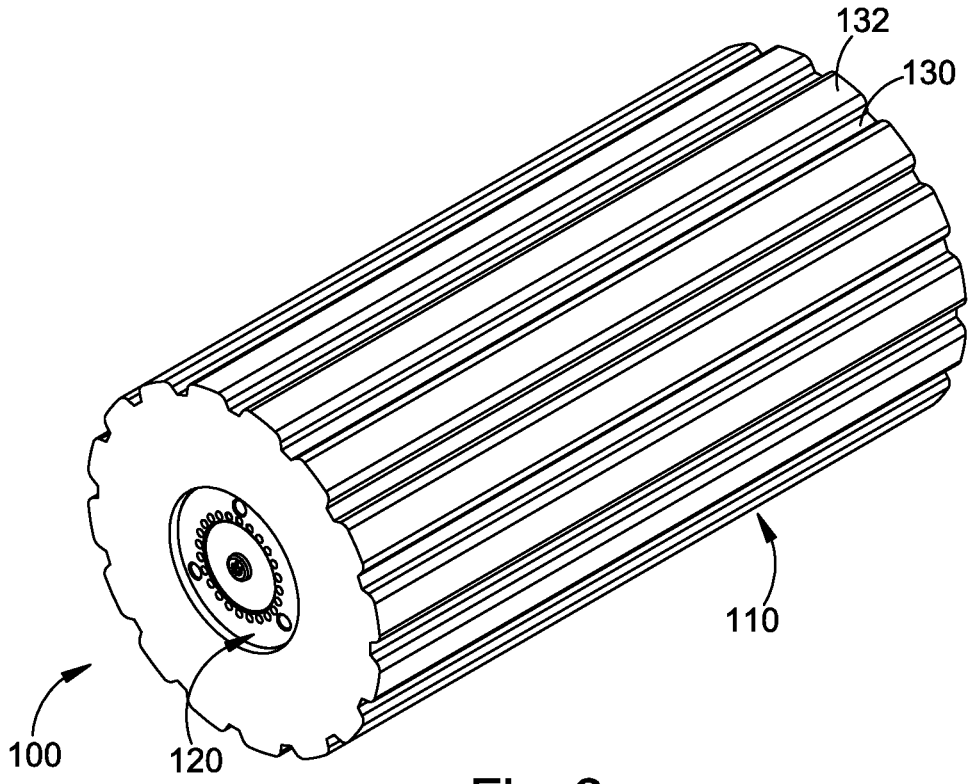
FIG. 2 illustrates a rear perspective view of the vibrating roller.

FIG. 1 and FIG. 2 illustrate a front perspective view and a rear perspective view, respectively, of a vibrating roller 100, which comprises a generally cylindrical outer roller structure 110 and an internal vibration generator 120 housed within the outer roller structure.

Figure 3:
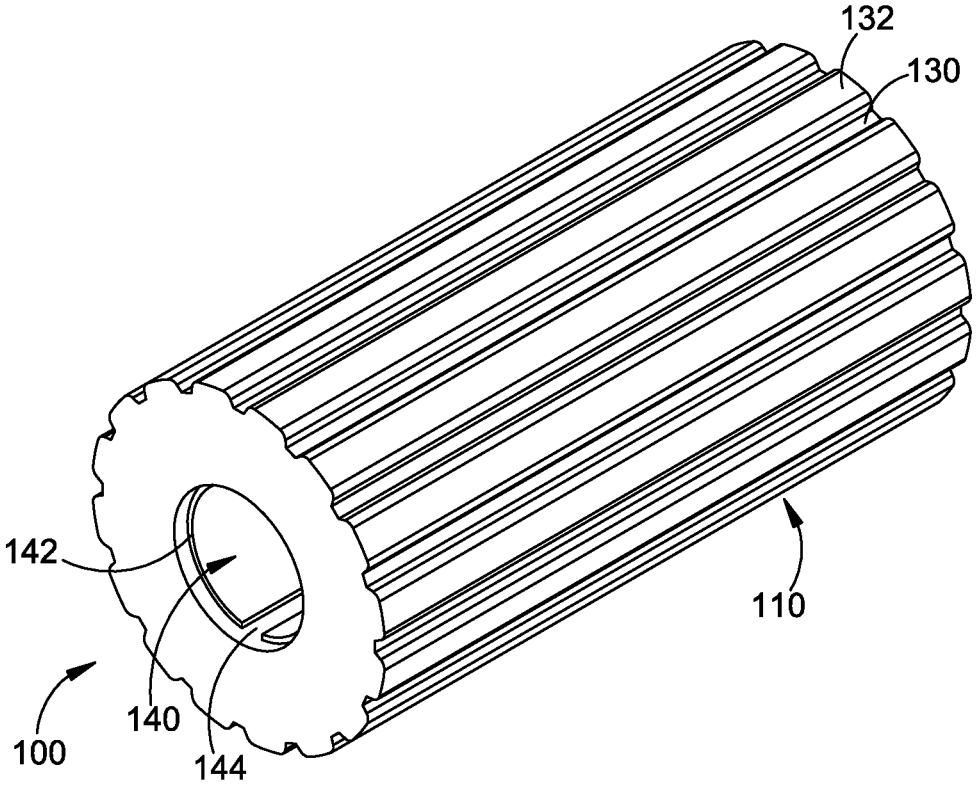
FIG. 3 illustrates a front perspective view of the cylindrical roller structure with the vibration mechanism removed from the longitudinal central core.
Figure 4:
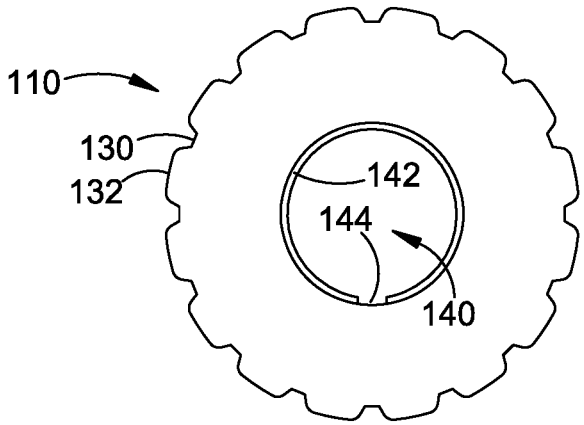
FIG. 4 illustrates a front elevational view of the cylindrical roller structure of FIG. 3.

As illustrated in FIGS. 3 and 4, the outer roller structure 110 comprises a pliable foam material, such as, for example, a closed-cell polyethylene foam. For example, the foam material may comprises MINICEL® L200, L300, L380 or the like, which is commercially available from Sekisui Voltek of Lawrence, Mass. The material is firm, yet is sufficiently pliable such that applying the roller to a person's body will not damage the underlying tissue.

In the illustrated embodiment, the outer roller structure 110 has an outer diameter of approximately 15 centimeters and a length of approximately 29.2 centimeters. As further shown in FIGS. 3 and 4, the outer circumference of the outer roller structure comprises a plurality of grooves 130 that are formed to a selected depth (e.g., approximately 0.5 centimeter in the illustrated embodiment). A corresponding plurality of ribs 132 comprise the material remaining between the grooves. The smaller surface areas of the ribs allow the user to apply a greater pressure per unit area to selected portions of a body when using the roller. In the illustrated embodiment, sixteen grooves and sixteen ribs are spaced around the outer circumference of the roller structure at intervals of approximately 22.5 degrees with each rib having an angular width of approximately 16 degrees and with each groove having an angular width of approximately 6.5 degrees.

The outer roller structure 110 further includes a longitudinal central bore 140 that extends the full length of the outer shell. The diameter of the central bore is selected to receive and restrain the vibration generator 120. For example, in the illustrated embodiment, the inner diameter of the central bore and a corresponding outer diameter of the vibration generator are approximately 6 centimeters. In certain embodiments, the outer roller structure is formed by injection molding to form the grooves 130, the ribs 132 and the central bore in one step. In the illustrated embodiment, the longitudinal bore has an inner circumferential shelf 142 proximate to each end of the bore. Each shelf is recessed approximately 0.66 centimeter from the respective end of the roller structure and extends radially inward from the bore about 0.25 centimeter. A longitudinal channel 144 extends longitudinally along the inner bottom surface of the bore. The longitudinal channel has a width of approximately 1 centimeter.

Figure 5:
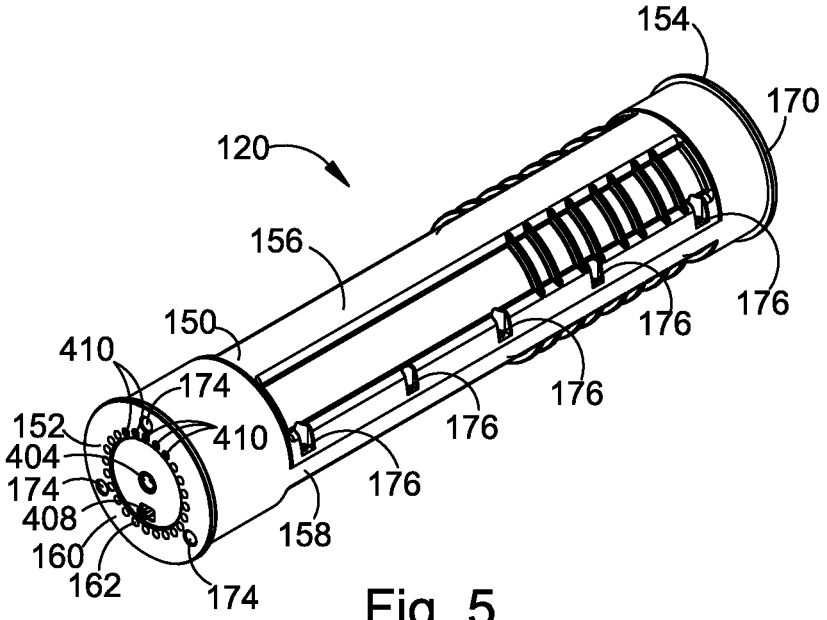
FIG. 5 illustrates a front perspective view of the vibration mechanism removed from the cylindrical roller.
Figure 6:
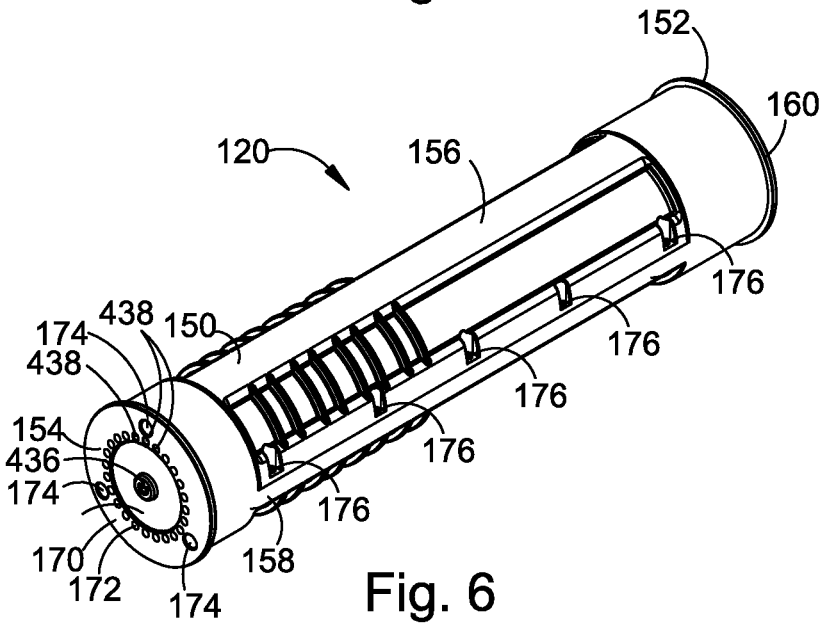
FIG. 6 illustrates a rear perspective view of the vibration mechanism removed from the cylindrical roller.
Figure 7:
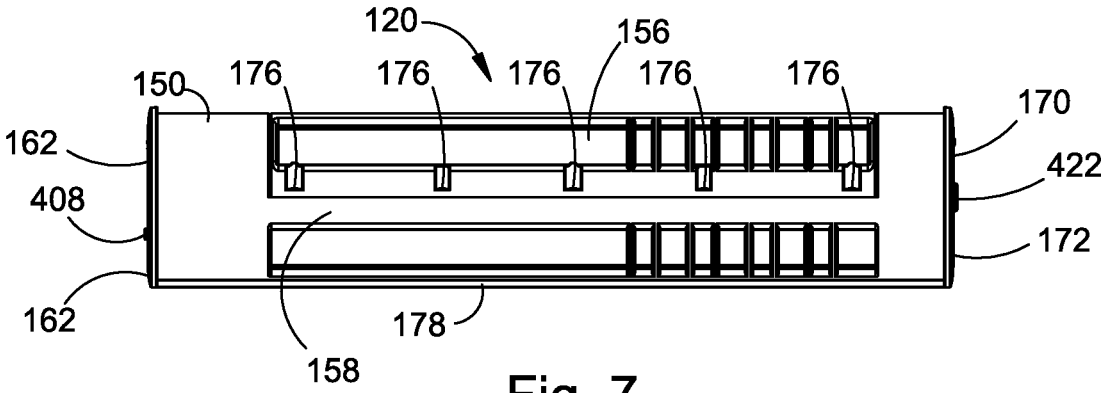
FIG. 7 illustrates a right side elevational view of the vibration mechanism of FIGS. 5 and 6.

FIGS. 5, 6 and 7 illustrates a front perspective view, a rear perspective view and a right side elevational view, respectively, of the vibration mechanism 120 removed from the cylindrical roller 110. The vibration mechanism comprises a generally cylindrical outer shell 150 having a first end 152 and a second end 154. In the illustrated embodiment, the cylindrical outer shell comprises an upper shell portion 156 and a lower shell portion 158. The first end is closed by a first end cap 160, which is penetrated by a plurality of through bores 162, which provide ventilation through the first end cap. The second end is closed by a second end cap 170, which is penetrated by a plurality of ventilation through bores 172. The end caps are secured to the upper and lower shell portions by a respective plurality of screws 174. The upper shell portion is secured to the lower shell portion by a plurality of screws. 176.

The cylindrical outer shell 150 has a length of approximately 28.3 centimeters between the two end caps 160, 162 so that the cylindrical shell, which is slightly shorter than the central bore 140 of the roller structure 110. Accordingly, when installed in the roller structure, the vibration mechanism 120 does not extend beyond the ends of the roller structure, as shown in FIG. 1. The foam material of the roller structure causes the inner circumference of the central bore to provide sufficient friction against the outer circumference of the vibration mechanism to restrain the vibration system within the central bore during ordinary use, while allowing the vibration system from the central bore if required for maintenance. Furthermore, the first end cap and the second end cap are screwed onto the first and second ends of the cylindrical shell after inserting the cylindrical shell into the cylindrical roller so that the two end caps are blocked from inward movement by the circumferential shelves 142 of the longitudinal bore 140 of the cylindrical roller. As shown in FIG. 7, the lower shell portion 158 has a longitudinal ridge 178 along the bottom that is positioned and sized to engage the longitudinal channel 144 of the central bore so that the cylindrical outer shell does not rotate within the central bore.

Figure 8:
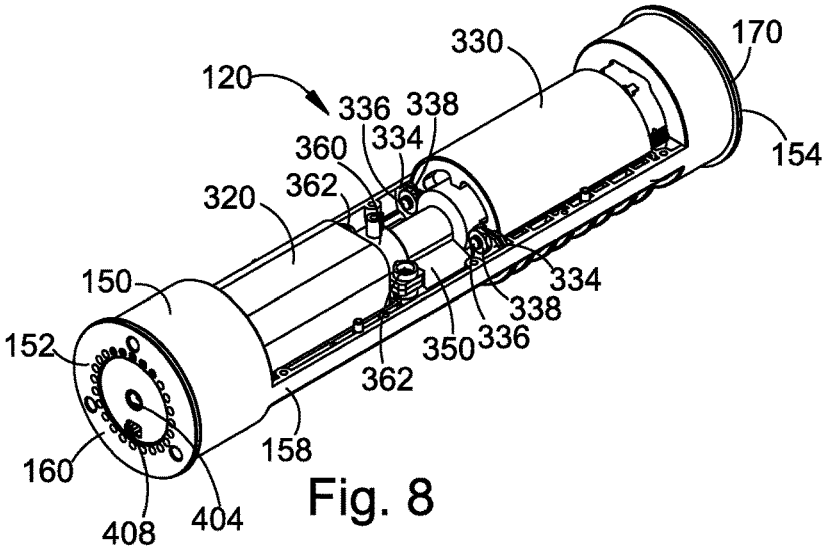
FIG. 8 illustrates the front perspective view of the vibration mechanism of FIG. 5 with the upper shell removed to show the internal components.
Figure 9:
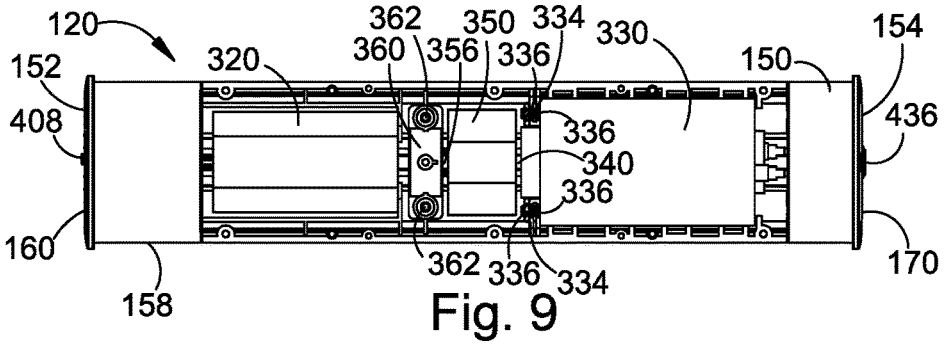
FIG. 9 illustrates a top plan view of the vibration mechanism of FIG. 8.
Figure 10:
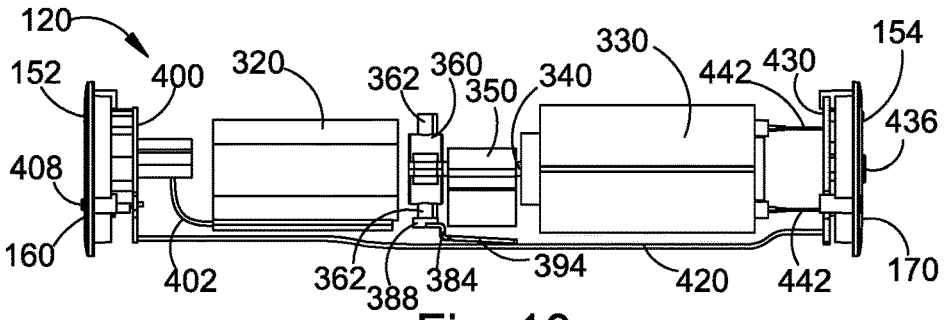
FIG. 10 illustrates a right side elevational view of the vibration mechanism of FIG. 7 with both the upper shell and the lower shell removed.
Figure 11:
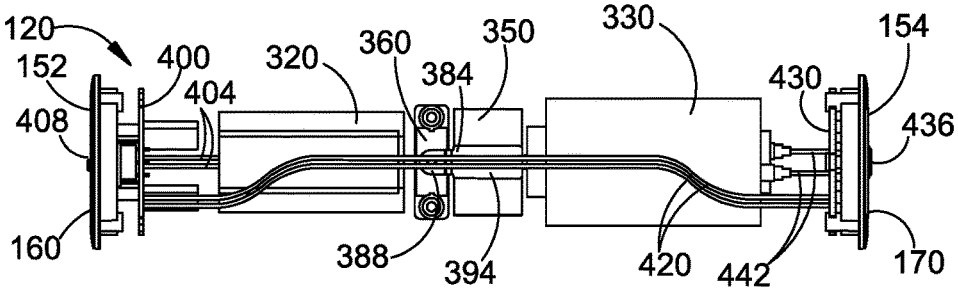
FIG. 11 illustrates a bottom plan view of the vibration mechanism of FIG. 10.

FIG. 8 illustrates the front perspective view of the vibration mechanism 120 of FIG. 5 with the upper shell 156 removed to show the internal components positioned in the lower shell 158. FIG. 9 illustrates a top plan view of the vibration mechanism of FIG. 8. FIG. 10 illustrates a right side elevational view of the vibration mechanism of FIG. 7 with both the upper shell and the lower shell removed. FIG. 11 illustrates a bottom plan view of the vibration mechanism of FIG. 10 with both the upper shell and the lower shell removed.

As shown in FIGS. 8-11, the internal components include a plurality (e.g., 4) of battery cells 320 which are electrically interconnected in series to provide a single DC output voltage. In the illustrated embodiment, the output voltage is nominally approximately 14.8 volts. The four cells are arranged in a generally rectangular, box-like enclosure (with rounded edges) having overall dimensions of approximately 70 millimeters by 42 millimeters by 38 millimeters and having a mass of approximately 200 grams. The battery cells are positioned near the first end 152 of the vibration mechanism 120. In one embodiment, the battery is a Model C1865CC-4S1P Lithium-Ion Battery commercially available from Shenkhen Bak Battery Co., Ltd. of Shenzhen, China.

A drive motor 330 is positioned near the second end 154 of the vibration mechanism. In the illustrated embodiment, the drive motor is a DC2925D012 12-volt DC electric motor commercially available from Donchang Motor (Shenzhen) Ltd. of Shenzhen, China. The drive motor has a loaded current of approximately 2.2 amperes and has a maximum loaded speed of approximately 3,250 rpm. By positioning the drive motor at the opposite end of the vibration mechanism from the battery 320, the masses of the components tend to at least partially offset so that the center of gravity of the vibration mechanism is near the center of the vibration mechanism between the two relatively massive components.

Figure 12:
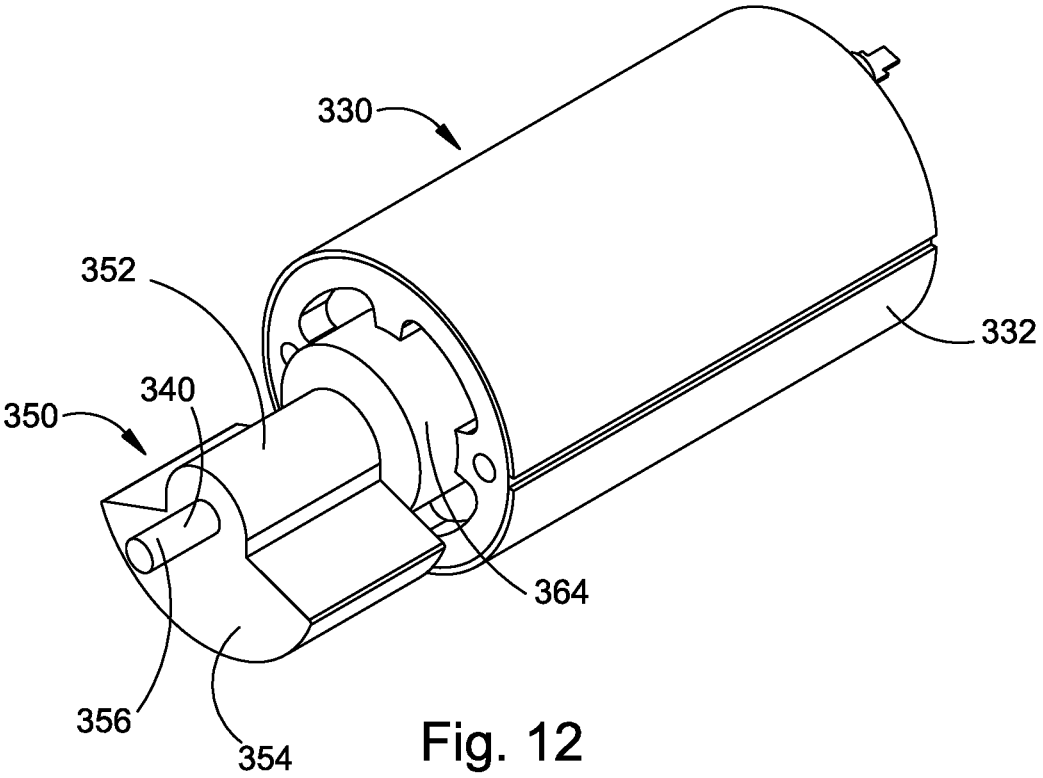
FIG. 12 illustrates a perspective view of the drive motor and the eccentric mass.

As shown in FIG. 12, the cylindrical outer perimeter of the drive motor 330 is surrounded by a generally cylindrical shockproof pad 332 to at least partially isolate the motor from physical shocks that may occur when the vibration mechanism is dropped or moved abruptly.

As shown in FIGS. 9 and 10, the drive motor 330 is secured to a pair of vertical brackets 334 that are formed in the lower shell portion 158. The drive motor is secured by a pair of screws 336 that pass through the length of the motor and engage respective threaded nuts 338 on the opposite side of the bracket from the drive motor.

The drive motor 330 has an output shaft 340 that extends toward the center of the vibration mechanism 120. An eccentric mass 350 (shown in more detail in FIG. 12) is secured to the output shaft of the drive motor. In the illustrated embodiment, the eccentric mass comprises an arcuate-shaped solid having an outer radius of approximately 2.1 centimeters with respect to the centerline of the output shaft of the motor. The eccentric mass has a central cylindrical portion 352 that surrounds and engages the output shaft of the drive motor. The central cylindrical portion has a radius of approximately 0.75 centimeter. A fan-shaped portion 354 of the eccentric mass extending from the central cylindrical portion to the outer radius of the eccentric mass spans an angular section of approximately 140 degrees. The eccentric mass has a longitudinal length along the output shaft of the drive motor of approximately 2.5 centimeters. In one embodiment, the eccentric mass comprises stainless steel and has a mass of approximately 170 grams.

As shown in FIG. 12, an extended portion 356 of the output shaft 340 of the drive motor 330 extends approximately 1.25 centimeters beyond the distal end of the eccentric mass 350. The extended portion is supported by a roller bearing assembly 360 (shown in more detail in FIG. 13), which is secured to the lower shell portion 158 by a pair of screws (not shown) that are inserted into a pair of alignment bores 362. The lengths of the output shaft and the position of the roller bearing mechanism are selected so that the eccentric mass is positioned substantially midway between the first end 152 and the second end 154 of cylindrical outer shell 150. As illustrated in the top view of FIG. 9, the length of the output shaft of the motor from a motor bearing 364, through the eccentric mass and through the roller bearing assembly is only a few millimeters longer than the longitudinal length of the eccentric mass. Thus, the output shaft is effectively prevented from wobbling in response to the rotation of the eccentric mass, which reduces wear on the motor bearing, the motor rotor and the bearings within the roller bearing assembly.

Figure 13:
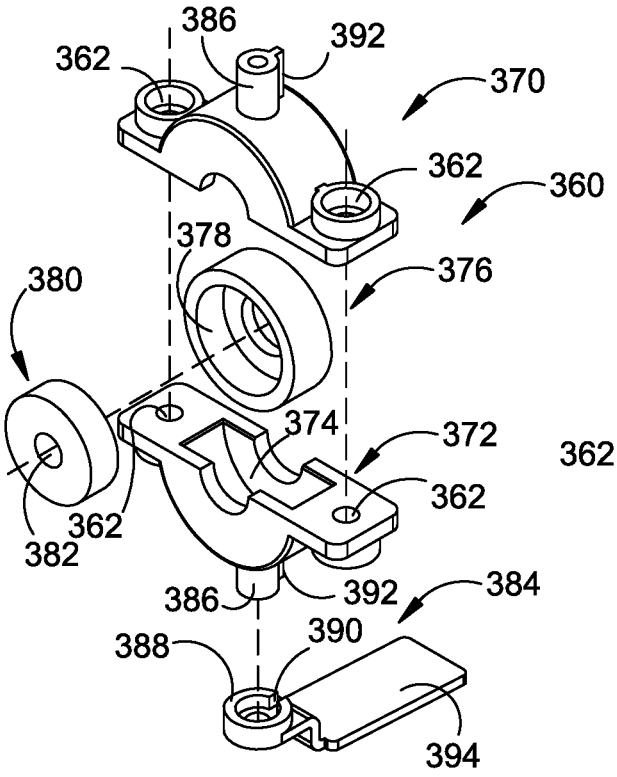
FIG. 13 illustrates an exploded perspective view of the roller bearing assembly that supports the shaft of the eccentric mass distal from the driving motor.
Figure 14:
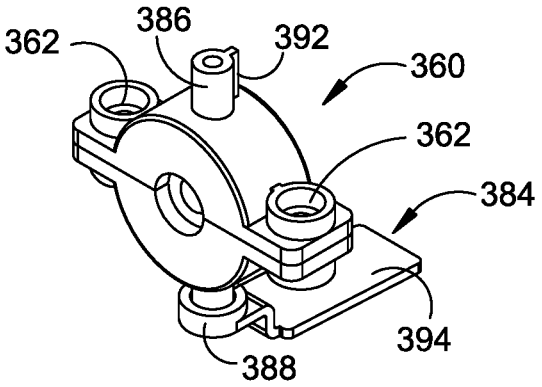
FIG. 14 illustrates an assembled perspective view of the roller bearing assembly of FIG. 13.

The roller bearing assembly 360 is shown in more detail in the exploded view of FIG. 13 and the assembled view of FIG. 14. The roller bearing assembly includes an upper bearing cover 370 and a lower bearing cover 372, which are substantially identical. Each bearing cover includes the pair of alignment bores 362. Each bearing cover includes a respective semicircular cavity 374. Each cavity is sized and shaped to receive an outer roller bearing race 376. The outer roller bearing race includes a circular cavity 378 that is sized and shaped to receive an inner roller bearing 380, which has an axial bore 382 sized to receive the extended portion 356 of the output shaft 340 of the drive motor 330. The roller bearing assembly is assembled by inserting the inner roller bearing into the outer roller bearing race, and then inserting the lower portion of the outer bearing race into the semicircular cavity of the lower bearing cover. The upper bearing cover is then aligned with the lower bearing cover and closed over the upper portion of the outer bearing race. Before inserting the roller bearing assembly into the lower shell half 158, as shown in FIGS. 8 and 9, a wire protection bracket 384 is positioned onto an extended cylindrical protrusion 386 on the bottom of the lower bearing cover. The wire protection bracket includes a circular collar portion 388 that is sized to fit the extended cylindrical protrusion. The collar has a slot 390 that engages a rib 392 on the cylindrical protrusion. The collar is secured to the cylindrical protrusion by a screw (not shown). The wire protection bracket further includes a generally L-shaped plate 394 that extends from the collar such that when the roller bearing assembly is secured to the lower shell half as shown in FIGS. 8 and 9, the plate is positioned between the eccentric mass 350 as shown in FIGS. 10 and 11. The wire protection plate protects wiring from the rotating eccentric mass as described below. The identical upper bearing cover also has the cylindrical protrusion and rib; however, the protrusion and rib are not used in the illustrated embodiment.

When power is applied to the drive motor 330 to rotate the eccentric mass 350, the rotation causes extensive vibrations of the eccentric mass, which are communicated to the lower shell portion 158. The upper shell portion 156 is secured to the lower shell portion by the plurality of screws 176 (FIGS. 5-7) so that the vibrations are further communicated to the upper shell portion. Accordingly, the entire cylindrical outer shell 150 is caused to vibrate by the rotation of the eccentric mass by the drive motor. Because of the central location of the eccentric mass, the amplitudes of the vibrations are greater near the center of the cylindrical outer shell. Thus, when the cylindrical outer shell is positioned in the longitudinal central bore 140 of the outer roller structure 110 as shown in FIGS. 1 and 2, the vibrations are communicated through the outer roller structure and are concentrated on the portions of the ribs 132 nearer the longitudinal center of the outer roller structure. Thus, when providing therapeutic massage to a body part, the outer roller structure can be gripped near each end where the vibrations have lower amplitudes. The central portion of the outer roller structure, where the vibrations have greater amplitudes, is applied to the body part (e.g., an arm, leg, back, neck or shoulder muscle) needing therapy.

The battery 320 is electrically connected to a first circuit board 400 via a pair of wires 402. The first circuit board is secured to the first end 152 of the cylindrical outer shell 150. As shown in FIG. 8, a charging terminal 404 extends from the first circuit board and through the first end cap 160 so that the charging terminal is accessible when the cylindrical outer shell is inserted in the outer roller structure 110 (FIG. 2). The charging terminal is electrically connectable to a conventional battery charger adapter (not shown) to charge the battery when needed. The charging terminal is electrically connected to a battery charging and control circuit 406 (shown schematically in FIG. 15, described below). The first end cap further includes a power switch 408 that is coupled to the first circuit board. The power switch selectively electrically connects and disconnects the battery from the other circuitry (described below) to provide switched battery power to the other circuitry. In certain embodiments, the first circuit board may include a plurality (e.g., 5) LEDs 410 that extend through selected ventilation holes 162 in the first end cap (FIG. 5) to provide an indication of the charge status in the battery.

The switched battery power from the first circuit board 400 is provided by a pair of wires 420 to a second circuit board 430, which is secured to the second end cap 170. When the cylindrical outer shell is assembled, the wires extending between the first circuit board and the second circuit board are positioned beneath the L-shaped plate 394 of the wire-protection bracket 384, and are thus shielded from contacting the rotating eccentric mass as shown in FIGS. 10 and 11.

The second circuit board 430 is electrically connected to a power/frequency selection pushbutton switch 436, which is centered in the second end cap 170 (FIG. 6). The second circuit board is further electrically connected to one or more indicator light emitting diodes (LEDs) 438 (e.g., three), which are positioned in one or more of the plurality of ventilation through bores 172 in the second end cap (FIG. 6). The second circuit board includes a motor control circuit 440 (shown schematically in FIG. 15), which is responsive to the pushbutton switch to control the rotational speed of the drive motor 330 via varying the voltage provided to the drive motor via a pair of wires 442. The motor control circuit thus controls the frequency of the vibrations caused by the rotating eccentric mass 350. The motor control circuit also selectively illuminates the indicator LEDs on the second circuit board to provide a display indicative of the selected rotational speed of the motor.

Figure 15:
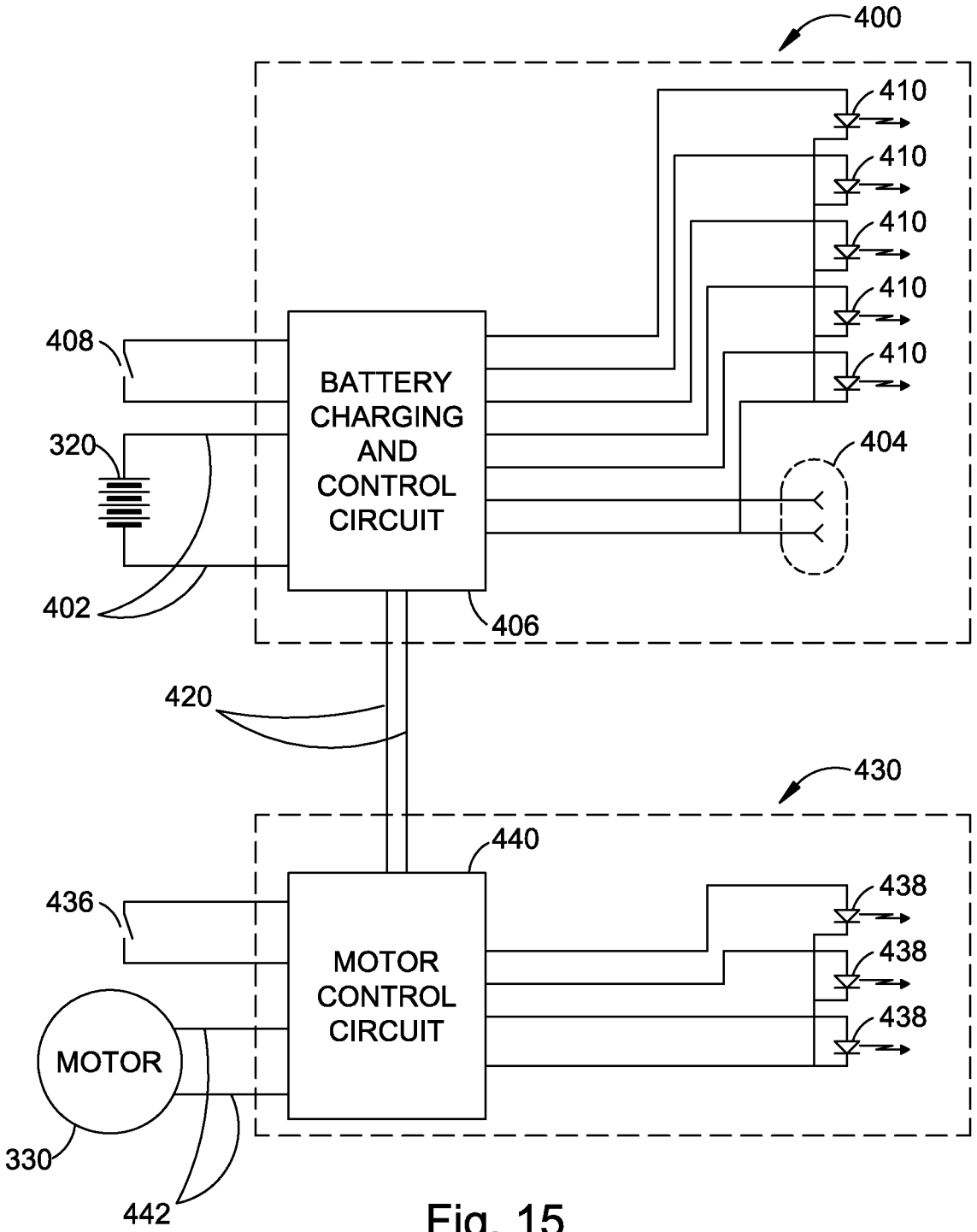
FIG. 15 illustrates a block diagram of the battery charger on the first printed circuit board and the motor speed controller on the second printed circuit board.

FIG. 15 illustrates a block diagram of the electrical connections of the first circuit board 400 and the second circuit board 430. As illustrated, the first circuit board includes the battery charging and control circuit 406 that is electrically connected to the battery 320, to the charging terminal 404 and to the first set of indicator LEDs 410. The battery charging and control circuit receives DC power via the charging terminal and selectively provides charging current to the battery cells 320 when an active DC adapter (not shown) is connected to the charging terminal. The battery charging and control circuit operates in a conventional manner to control the charging current to assure that the battery is not overcharged. The battery charging and control circuit also monitors the status of the battery and provides an indication of the charge status of the battery via the first set of indicator LEDs The battery charging and control circuit 406 is electrically connected to the motor control circuit 430 on the second circuit board 430 via the wires 420 to provide DC voltage to the motor control circuit when the vibration circuit is selectively activated via the pushbutton power switch 408. The motor control circuit is responsive to the applied DC voltage to provide power to the drive motor 330 via the wires 440. The motor control circuit operates in a conventional manner to control the rotational speed of the drive motor, which in turn controls the frequency of the vibration caused by the rotating eccentric mass 350. For example, in one embodiment, the motor control circuit may be a pulse-width modulation (PWM) control circuit that controls the speed by varying the duty cycles of pulses to control the power provided to the motor. The motor control circuit is responsive to repeated activations of the pushbutton switch to cycle between an off position and two or more rotational speeds. For example, in one embodiment, the pushbutton switch selects between off and at least three rotational speeds. The motor control circuit is electrically connected to the one or more LEDs 438 to display the selected operation. For example, in one embodiment, a single tricolor LED may be operable to selectively display red, green or blue, with each color representing an operating speed/vibration frequency. Alternatively, the single tricolor LED can be replaced with separate LEDs that represent each operating speed/vibration frequency. For example, in the embodiment illustrated in FIG. 15, three LEDs are provided to identify up to three operating speeds and corresponding vibration frequencies.

As discussed above, when operating the vibrating roller 100, a user selects an operating speed/vibration frequency for particular activities or particular parts of the body (e.g., arms, legs, neck, back or the like).

As various changes could be made in the above constructions without departing from the scope of the invention, it is intended that all the matter contained in the above description or shown in the accompanying drawings shall be interpreted as illustrative and not in a limiting sense.

What is claimed is:

1. A portable vibrating roller for therapeutic exercise, comprising:

an outer roller structure comprising a firm, pliable foam material formed as a cylinder having a generally cylindrical outer circumference, the structure including a plurality of grooves and ribs positioned around the outer circumference, the structure including a hollow cylindrical bore extending longitudinally through the foam material; and a vibration system comprising a shell sized to fit within the hollow cylindrical bore of the outer roller structure, the shell having a first end portion with a first end cap and a second end portion with a second end cap, the shell having a middle portion approximately midway between the first end portion and the second end portion, the shell enclosing and supporting:

a motor having a first end and a second end, the first end of the motor positioned closer to the first end portion of the shell than to the middle portion of the shell, the second end of the motor positioned away from the first end portion of the shell and facing the middle portion of the shell, the motor responsive to applied power to rotate an output shaft at a selected one of a plurality of angular velocities, the output shaft having a coupling portion extending from the second end of the motor into the middle portion of the shell;

an eccentric mass having a first side and a second side, the eccentric mass coupled to the coupling portion of the output shaft of the motor with the first side of the eccentric mass directed toward the motor and with at least an extended portion of the coupling portion of the output shaft extending beyond the second side of the eccentric mass in a direction toward the second end portion of the shell, the eccentric mass positioned in the middle portion of the shell, the eccentric mass configured to rotate and cause vibration when the output shaft is rotated by the motor;

a bearing assembly mounted to the shell and positioned to receive the extended portion of the coupling shaft, the bearing assembly positioned on the shell to support the eccentric mass in the middle portion of the shell;

a battery having a first end and a second end, the first end of the battery positioned closer to the second end portion of the shell than to the middle portion of the shell, the second end of the battery positioned away from the second end portion of the shell and facing the middle portion of the shell; and a motor control circuit, the motor control circuit coupled to receive input power from the battery and to selectively provide output power to the motor, the motor control circuit responsive to the operation of a switch on one of the first end cap and the second end cap to vary the output power provided to the motor to control the angular velocity of the output shaft of the motor and to thereby control a frequency of vibrations caused by the eccentric mass.

2. The portable vibrating roller as defined in claim 1, wherein the positioning of the eccentric mass causes the vibrations generated by the eccentric mass to have a greater amplitude nearer to the middle portion of the shell than to the first end portion of the shell and the second end portion of the shell.

3. The portable vibrating roller as defined in claim 1, wherein the position of the motor proximate to the first end portion of the shell and the position of the battery proximate the second end portion of the shell cause the vibration system to have a center of gravity nearer the middle portion of the shell than to either of the first end portion of the shell or the second end portion of the shell.

4. The portable vibrating roller as defined in claim 1, wherein the angular velocity of the output shaft of the motor and the resulting frequency of vibration caused by the eccentric mass are selected to provide a desired vibrational effect to tissues of a body when the outer circumference of the outer roller structure is applied to the body.

5. A vibration system for therapeutic massage, comprising:

a cylindrical shell forming a roller structure; the shell having a first end portion extending to a first end cap and having a second end portion extending to a second end cap, the shell having a middle portion approximately midway between the first end portion and the second end portion;

a motor having a first end and a second end, the motor positioned within the shell with the first end of the motor closer to the first end portion of the shell than to the middle portion of the shell and with the second end of the motor positioned away from the first end portion and facing the middle portion of the shell, the motor responsive to applied power to rotate an output shaft at a selected one of a plurality of angular velocities, the output shaft having a coupling portion extending from the second end of the motor;

an eccentric mass having a first side and a second side, the first side of the eccentric mass positioned near the second side of the motor, the coupling portion of the output shaft of the motor extending through the eccentric mass with an extended portion of the output shaft extending beyond the second side of the eccentric mass, the eccentric mass coupled to the coupling portion of the output shaft of the motor and configured to rotate and cause vibration when the output shaft is rotated by the motor, the eccentric mass positioned in the middle portion of the shell;

a bearing assembly mounted to the shell and positioned to receive the extended portion of the coupling shaft, the bearing assembly positioned on the shell to support the eccentric mass in the middle portion of the shell;

a battery having a first end and a second end, the first end of the battery positioned closer to the second end portion of the shell than to the middle portion of the shell, the second end of the battery positioned away from the second end portion of the shell and facing the middle portion of the shell; and a motor control circuit, the motor control circuit coupled to receive input power from the battery and to selectively provide output power to the motor, the motor control circuit responsive to the operation of a switch on one of the first end cap and the second end cap to vary the output power provided to the motor to control the angular velocity of the output shaft of the motor and to thereby control a frequency of vibrations caused by the eccentric mass.

* * * * *